United States Patent [19]

Sato

[11] Patent Number: 4,540,878

[45] Date of Patent: Sep. 10, 1985

[54] NET CIRCUIT TYPE HEATING AND WARMING EQUIPMENT

[76] Inventor: Ryoda Sato, 8-25 Obamacho 1-chome, Amagasaki-shi Hyogo-ken, Japan

[21] Appl. No.: 583,060

[22] Filed: Feb. 23, 1984

[30] Foreign Application Priority Data

Jun. 2, 1983 [JP] Japan ..... 58-96971

[51] Int. Cl.[3] ..... H05B 3/34

[52] U.S. Cl. ..... 219/545; 219/212; 219/213; 219/549; 338/208; 338/293

[58] Field of Search ..... 219/211, 212, 213, 345, 219/527, 528, 529, 541, 545, 535, 549; 338/208, 209, 210, 283, 293; 174/35 R, 36, 107, 117 M, 124 R

[56] References Cited

U.S. PATENT DOCUMENTS

| | | | |
|---|---|---|---|
| 975,359 | 11/1910 | Hefter | 338/208 X |
| 1,760,057 | 5/1930 | Hawley | 338/210 X |
| 1,962,041 | 6/1934 | Spong | 338/208 X |
| 2,345,300 | 3/1944 | Simpson et al. | 338/208 |
| 2,884,509 | 4/1959 | Heath | 338/208 |
| 2,922,867 | 1/1960 | Crump | 219/545 |
| 2,938,992 | 5/1960 | Crump | 338/208 X |
| 2,997,568 | 8/1961 | Leipold et al. | 338/208 X |
| 3,349,359 | 10/1967 | Morey | 338/208 |
| 3,946,194 | 3/1976 | Bretoiere | 219/213 |
| 4,375,009 | 2/1983 | Fearnside et al. | 174/36 |

*Primary Examiner*—Volodymyr Y. Mayewsky
*Attorney, Agent, or Firm*—Burgess, Ryan and Wayne

[57] ABSTRACT

A heating cord comprises bendable electric heating wire and nonconductive fiber. A net type heater is formed from the heating cords. Common power source terminals comprising a plurality of bendable conductors are fixed at both sides of the net type heater and are connected to the electric heating wire thereof.

6 Claims, 12 Drawing Figures

NET CIRCUIT TYPE HEATING AND WARMING EQUIPMENT

BACKGROUND OF THE INVENTION

The present invention relates to a net type heating device for heating a broad area such as a roof or a farm to keeping the broad area warm.

Conventionally, an electric heating device for heating a broad area or keeping a broad area warm uses a single electric wire arranged in a spiral or zigzag pattern. However, when a disconnection occurs at a part of the single electric wire of a conventional electric heating device, heating or warming is interrupted. Also, a conventional electric heating device of this type cannot be used for heating a broad area or keeping a broad area warm by low voltage and high current, because the current flow is limited by the single wire.

In order to solve the above problem, the present inventor provided a heating sheet in which a plurality of electric heating wires, which are substantially parallel to each other, are woven into one sheet, and the electric wires are connected to common power soruce terminals which are provided at both sides or the middle and sides of the sheets.

In the above heating sheet, however, the heat produced by the electric heating wires is collected in the heating sheet. Therefore, the heating sheet cannot uniformly heat the area between the electric heating wires. Also, the above heating sheet requires a large number of sheets for heating a broad area or keeping a broad area warm. Furthermore, the above heating sheet is not expandable and contractable.

A technique for obtaining a heating sheet in which nonconductive fibers and fine metal wires are woven in turn is known. The woven heating sheet does not possess suitable expansion and contraction ability and is not bendable for directly weaving the metal wires into the nonconductive fiber, resulting in inconvenience.

SUMMARY OF THE INVENTION

It is, therefore, an object of the present invention to provide an expandable, contractable and bendable net type heating device having high thermal efficiency.

It is another object of the present invention to provide a net type heating device which remains trouble-free even if one of the heating wires becomes disconnected.

In order to achieve the above objects of the present invention, there is provided a net type heating device comprising: a net type heater which is formed from heating cords, the heating cords comprising interwoven flexible electric heating wires and nonconductive fibers or flexible electric wires around nonconductive fibers and common power source terminals having a plurality of flexible conductors fixed at the sides of the net type heater, or at the sides and the center, the conductors of the common power source terminals being connected to the electric heating wires of the net type heater.

DESCRIPTION OF THE PREFERRED EMBODIMENTS

Figure 1:
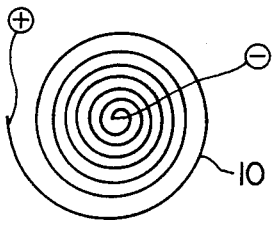
FIG. 1 (a) (PRIOR ART)
FIGS. 1(*a*) and 1(*b*) are wiring diagrams of heating wires of a conventional electric heating device.
Figure 1:
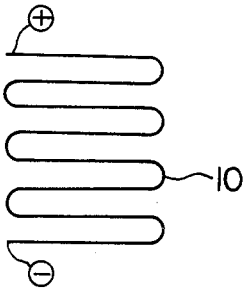
FIG. 1 (b) (PRIOR ART)

Before describing embodiments of the present invention, a conventional electric heating device will be described in order to provide an understanding of the advantages of the present invention. FIGS. 1(*a*) and 1(*b*) show the patterns of a single nichrome wire used in conventional electric heating equipment. Referring t FIG. 1(*a*), a nichrome wire 10 is formed in a spiral pattern. Referring to FIG. 1(*b*), a nichrome wire 10 is formed in a zigzag pattern.

In the conventional electric heating devices, because only a single nichrome wire is used, when a disconnection occurs at a part of the single wire, heating or warming cannot be performed.

Figure 2:
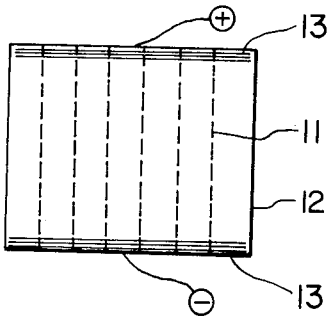
FIG. 2 (PRIOR ART)
FIG. 2 is a plan view of a heating sheet which has a plurality of parallel heating wires woven into a sheet.

FIG. 2 is a plan view of a heating sheet developed by the present inventor which is outside the present invention. A plurality of heating wires 11 which are substantially parallel to each other are fixed on a surface of a nonconductive fiber sheet. Common power source terminals 13, each of which comprises a plurality of conductors 14, are fixed on the nonconductive fiber sheet 12 at the two ends of the respective heating wires 11, such that they cross the heating wires 11. The common power source terminals 13 are respectively connected to the positive and negative terminals of a DC or AC power source.

In this heating sheet, however, the heat produced by the electric heating wires is collected in the nonconductive fiber sheet 12. Therefore, the heating sheet cannot uniformly heat the area between the electric heating wires 11. Also, the heating sheet 12 requires a large amount of heat for heating a broad area or keeping a broad area warm. Furthermore, the heating sheet is not expandable and contractible.

Figure 3A:
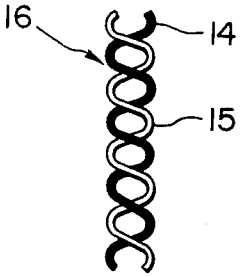
FIGS. 3(*a*) and 3(*b*) are side views of heating cords used in embodiments of the present invention.
Figure 3B:
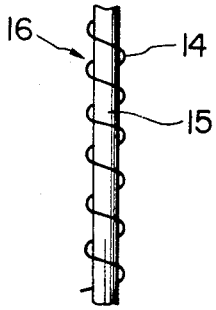

FIGS. 3(*a*) and 3(*b*) show side views of heating cords used in the net type heating device of the present invention. The heating cords 16 consist of bendable flexible electric heating wires 14 and bendable nonconductive fibers 15. In FIG. 3(*a*), the heating cord 16 is formed by interwinding of the bendable electrical conducting wires 14 and conducting wires 15. In FIGS. 3(*b*), the heating cord 16 is formed from the bendable electric heating wire 14 wound around the nonconductive fiber 15.

Figure 4A:
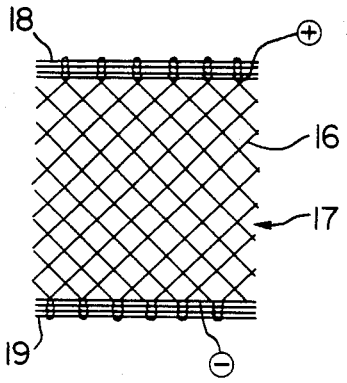
FIGS. 4(*a*) and 4(*b*) are plan views of net type heating devices of embodiments of the present invention.
Figure 4B:
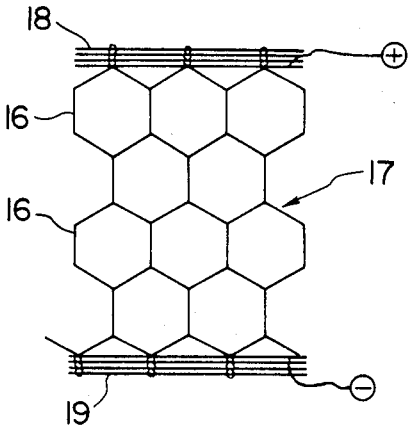

FIGS. 4(*a*) and 4(*b*) show a plan view of a net type heater embodiment of the present invention. In FIG. 4(*a*), the net type heater 17 comprises quadrilateral meshes formed from heating cords 16. The electric conducting wires of the heating cords make electric contact where they cross. Common power source terminals 18 and 19 are connected to both sides of the net type heater 17. In FIG. 4(*b*), the net type heater 17 wherein the meshes are hexagonal is formed from the heating cords 16. Also, the common power source terminals 18, 19 are connected to the both sides of the net type heater 17.

Figure 5:
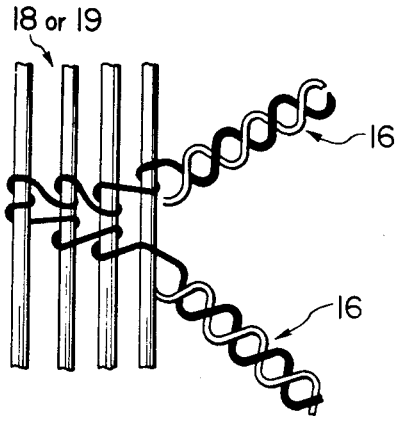
FIG. 5 is a plan view of a common power source terminal having a plurality of flexible and bendable conductors to which the electric heating wires of the cords of the net type heater are connected.

Generally, flexible and bendable wires are used since they are easy to shape into the form of a heating device of the present invention. However, when the heating device is made from only the bendable wire, the heating device does not have sufficient strength, particularly in tension. Therefore, it is necessary to form the heating device from the bendable flexible heating cord 16 of the present invention, which is formed by interweaving the bendable electric heating wires 14 and the non-conductive fibers 15 or which is formed by winding the bendable wires 14 around the nonconductive fibers 15. The electric heating wire 14 comprises a conductive wire which is preferably steel wire or a nichrome wire. Steel wire is preferred since it is resistant to bending fatigue and has sufficient tensile strength. The nonconductive fiber 15 comprises a plastic fiber such as polyamide, polyester or vinyl polymer fiber or a natural fiber such as cotton. The nonconductive fiber must be heat resistant in the range of intended use. Aryl polyamides and arylpolyamide fibers provide a heating cord useful at relatively high temperatures. Fire resistant fibers can also be used to form the heating cord. In order that the heating device be easy to bend, the common power source terminals 18 and 19, must be formed of very thin conductive wires. However, when one thin wire is used for the common power source terminals 18 and 19, respectively, one wire is easy to break by bending and pulling, and its electrical connection is generally poor. Therefore, as shown in FIG. 5, the common power source terminals 18 and 19 comprises a plurality of bendable wires which are connected to the electric heating wires 14 of the heating cords 16. The heating cords 16 shown in FIG. 5 are the same as those in FIG. 3(*a*).

The net type heating device of the present invention comprises a net heater 17 which is formed from the bendable flexible heating cords 16. Since it is flexible and expandable, the net heating device of the present invention can conform to the shape of an object to heat the object and keep it warm. Since electric current uniformly flows into the net heater 17 from the common power source terminals 18 and 19, the net heating device of the present invention can uniformly heat the objects. Also, since the electric heating wires 14 in the heating cords form the net, even if one of the electric heating wires 14 is broken, the other wires heat the object, and thus, the heating and warming are not affected by the disconnection. In the net type heating device according to the present invention, a large number of sheets are not required, since the heating device can be readily expanded to cover a large area.

Figure 6:
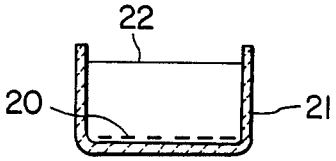
FIG. 6 is a sectional view showing a bathtub in which the net type heating device of the present invention is installed.
Figure 7:
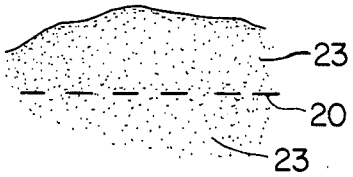
FIG. 7 is a partial sectional view showing an installation for heating the ground of a farm by a net type heating device of the present invention buried in the ground.
Figure 8:
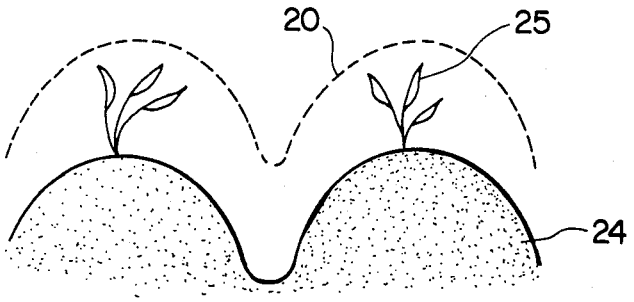
FIG. 8 is a sectional view showing an installation for heating growing farm products to prevent damage from frost by covering the growing plants with net type heating device of the present invention.
Figure 9:
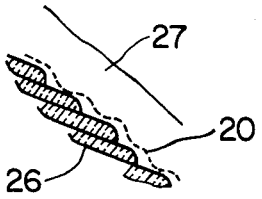
FIG. 9 is a partial sectional view showing the net type heating device mounted on a roof to melt snow thereon.

FIGS. 6 to 9 show application examples using the net type heating device of the present invention. In FIG. 6, the net type heating device 20 is placed in the bottom of a bathtub 21 and the water 22 in the bathtub 21 is heated and warmed. In FIG. 7, the net type heating device 20 is buried in the ground 23 of a farm to heat and warm the ground. In FIG. 8, the net type heating device 20 is used to cover growing farm plants 25 which are planted in the earth 24 of the farm, and the farm plants 25 are protected from damage by frost. In FIG. 9, the net type heating device 20 is placed over a roof 26, and the snow 27 fallen on the roof 26 is melted from the roof 26.

As is well known in the art, the size or diameter of the conducting wires in the heating cords is determined by the number of heating cords, the length of the heating cords, the amount of heat to be provided and the voltage and current available for application to the device.

What is claimed is:

1. A net type heating device, comprising:

first and second spaced common power source terminals, each of said terminals comprising a plurality of adjacent bendable wires; and a plurality of heater cords formed in a mesh-like arrangement disposed between said first and seond common power source terminals, said mesh-like arrangement having a multiplicity of nodes a plurality of said heater cords meeting at each node, said nodes being in electrical contact with each other and with both of said common power source terminals, each of said heater cords comprising a heat-resistant nonconductive fiber and a bendable electrically conductive heating wire interwound with said nonconductive fiber, the heating wires of the heater cords meeting at each node being electrically connected to each other at the node where they meet, the heating wires of the heate cords adjacent each of said first and second common power source terminals being wound around each individual ones of the adjacent bendable wires of the corresponding one of said terminals, to electrically and mechanically secure said heater cords to said terminals.

2. A net type heating device according to claim 1, wherein meshes of said net type heater are quadrilateral.

3. A net type heating device according to claim 1, wherein meshes of said net type heater are hexagonal.

4. A net type heating device according to claim 1, wherein said electric heating wire comprises steel.

5. A net type heating device according to claim 1, wherein said nonconductive fiber comprises heat-resistant plastic fiber.

6. A net type heating device according to claim 1, wherein said nonconductive fiber comprises natural fiber.

* * * * *